US007129848B2

(12) United States Patent
Milliot et al.

(10) Patent No.: US 7,129,848 B2
(45) Date of Patent: Oct. 31, 2006

(54) REMOTE MONITORING METHOD AND SYSTEM

(75) Inventors: Fréderic Milliot, Paris (FR); Gilles Ambone, Courbevoie (FR)

(73) Assignee: Alcatel, Paris (FR)

( * ) Notice: Subject to any disclaimer, the term of this patent is extended or adjusted under 35 U.S.C. 154(b) by 138 days.

(21) Appl. No.: 10/791,887

(22) Filed: Mar. 4, 2004

(65) Prior Publication Data

US 2004/0181693 A1 Sep. 16, 2004

(30) Foreign Application Priority Data

Mar. 11, 2003 (EP) ..... 03290601

(51) Int. Cl.
*G08B 17/10* (2006.01)

(52) U.S. Cl. ..... 340/628; 340/531; 340/539.1; 340/539.26; 340/541; 340/825.69; 340/825.72

(58) Field of Classification Search ..... 340/628, 340/630, 632, 539.1, 539.13, 539.19, 540, 340/541, 825.49, 825.69, 825.72, 539.26, 340/525, 531; 348/152, 153, 169, 143, 155
See application file for complete search history.

(56) References Cited

U.S. PATENT DOCUMENTS 5,745,849 A 4/1998 Britton
6,150,927 A * 11/2000 Nesbitt ..... 340/426.25
6,271,752 B1 8/2001 Vaios
6,608,557 B1 * 8/2003 Menard et al. ..... 340/506
6,624,750 B1 * 9/2003 Marman et al. ..... 340/506
6,727,811 B1 * 4/2004 Fendis ..... 340/506
6,771,741 B1 * 8/2004 Kliland ..... 379/39
6,930,598 B1 * 8/2005 Weiss ..... 340/531

OTHER PUBLICATIONS

Service Loading—Version 31—Jul. 2001 Wireless Application Protcol—WAP-168-ServiceLoad- 20010731-a.

* cited by examiner

*Primary Examiner*—Hung Nguyen
(74) *Attorney, Agent, or Firm*—Sughrue Mion, PLLC

(57) ABSTRACT

The present invention relates to a remote monitoring method comprises the steps of monitoring an occurrence of an event, providing a signal to a wireless module in response to the occurrence of the event, sending a wireless application protocol request being indicative of the occurrence of the event to a first gateway, converting the wireless application protocol request to a first hypertext transfer protocol request, sending of the first hypertext transfer protocol request to a server, determining at least one receiver address for the first hypertext transfer protocol request by the server, sending of a second hypertext transfer protocol request from the server to a second gateway, sending of a wireless application protocol service loading message to the at least one receiver from the gateway.

9 Claims, 2 Drawing Sheets

REMOTE MONITORING METHOD AND SYSTEM

The invention is based on a priority application EP 03 290 601.8 which is hereby incorporated by reference.

FIELD OF THE INVENTION

The present invention relates to the field of remote monitoring systems and methods, and more particularly without limitation, to remote fire, smoke, motion and/or sound detection.

BACKGROUND AND PRIOR ART

Various remote premise-monitoring alarm systems are known from the prior art. For example, U.S. Pat. No. 5,745,849 shows a combination of a cordless telephone and a premise-monitoring alarm system which has a base unit, a cordless handset and one or more remote alarm detectors.

The alarm detectors can be generally either smoke detectors, motion detectors, or open-entry detectors. The base unit includes at least one interface for the public telephone network, and another interface for radio communication with the cordless handset. The base unit preferably also communicates with the remote alarm sensors across the same radio interface. The base unit includes telephone call circuitry to relay telephone calls between the public telephone network and the handset. The base unit also includes alarm processing circuitry to send an alarm warning to a central alarm-monitoring station in response to an alarm signal from a remote detector. The base unit has control circuitry that is configured such that if, during a telephone call, the base unit is given an alarm signal, the base unit will either (i) hang up the telephone call and call up the central alarm-monitoring station to give warning, or (ii) call up the central alarm-monitoring station on a second telephone line.

U.S. Pat. No. 6,271,752 shows a multi-access remote monitoring system for monitoring of a security surveillance area. The security surveillance area comprises a local computer system, a network interface, and a camera having a motion sensor. The local computer system is electronically connected via a camera adapter to the video camera so that video, sound, and motion sensor data can be transmitted from the camera to the local computer system, and instructions or other data can be transmitted from the local computer system to the camera. The local computer system is additionally connected to a computer network interface, which may be a modem, network card, or other communications hardware, used to connect to the communications network. The local computer system includes various components, including an audio/video coder/decoder, fixed storage means, operating system software, communications software, compression software, and application programming interface (API) software.

It is a common disadvantage of prior art remote monitoring systems that special, dedicated hardware is required at the site which is monitored. The present invention therefore aims to provide an improved remote monitoring method and system which enables to limit the hardware expenditure for the surveillance zone.

SUMMARY OF THE INVENTION

The present invention provides for a remote monitoring method which uses the wireless application protocol and the hypertext transfer protocol for transmitting a signal, such as an alarm, alert or warning signal, from the surveillance zone to at least one receiver. This requires only a sensor being coupled to a wireless module at the surveillance zone.

The occurrence of an event is communicated from the wireless module to a monitoring server by means of the wireless application protocol through a wireless application gateway. The server determines one or more receiver addresses for the signal and forwards the signal to the one or more receivers through a wireless application protocol gateway. For example, the wireless application protocol gateway sends a service loading message to the one or more receiving mobile terminals in order to transmit the signal.

The service loading (SL) content type has been defined in the wireless application protocol standard WAP-168-serviceload-20010731-a (http://www.wmlclub.com/docs/especwap2.0/WAP-168-ServiceLoad-20010731-a.pdf). The SL content type provides a means to convey a uniform resource identifier (URI) to a user agent in a mobile client. The client itself automatically loads the content indicated by that URI and executes it in the addressed user agent without user intervention when appropriate. Thus, the end-user will experience the service indicated by the URI as if it was pushed to the client and executed. By basically conveying only the URI of the service to the client the over-the-air message will be small. Hence, very modest requirements are placed on the bearer and on the clients ability to receive and store a SL if it is busy with other activities.

Instead of executing the service, SL provides a means to instruct the client to pre-cache the content indicated by the URI so it becomes readily available to the user agent and the client. It is also possible to control whether the loading of the service is to be carried out in a user-intrusive manner or not.

In accordance with a preferred embodiment of the invention the server instructs the gateway to push a SL to the mobile client using the push access protocol (PAP). The push initiator, i.e. the server, provides the SL with the URI to the wireless mark up language (WML) that is executed in the client's user agent. The gateway sends the SL to the mobile client using the push over-the-air protocol (OTA). Next the mobile client receives the push containing the SL. The service which is indicated by the SL's URI is retrieved ('pulled') from the monitoring server via the gateway.

For example data which is indicative of the circumstances of an event which has been detected is signalled from the sensor to the wireless module. This data can include an identifier of the sensor, information on the kind of event, time information and/or other information. This information is sent from the wireless module through the wireless application protocol gateway to the monitoring server. There the data is stored and an URI is assigned to the data. This URI is sent to the mobile client as part of the SL. This enables the mobile client to retrieve the data from the monitoring server by means of the URI. This is particularly advantageous as the user can get additional information on the circumstances of the event rather than just the warning or alert message.

BRIEF DESCRIPTION OF THE DRAWINGS

In the following preferred embodiments of the invention will be described in greater detail by making references to the drawings in which.

DETAILED DESCRIPTION

Figure 1:
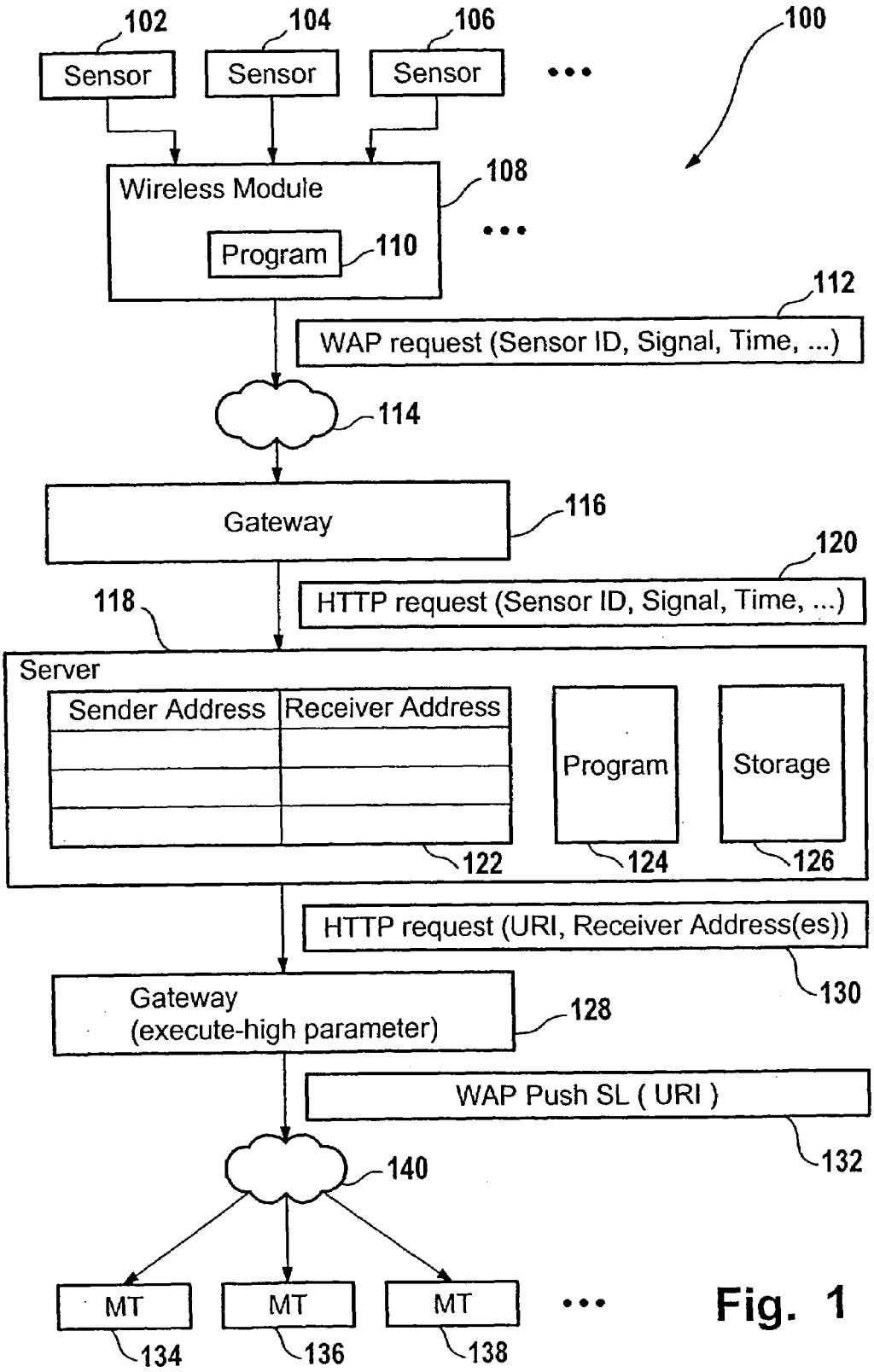
FIG. 1 is a block diagram of a wireless remote monitoring system.

FIG. 1 shows wireless remote monitoring system 100 comprising one or more monitoring sensors 102, 104, 106, . . . at one or more surveillance areas. The sensors 102, 104, 106, . . . are coupled to wireless module 108. For example wireless module 108 is coupled to a group of sensors of the same surveillance area. Alternatively there is a dedicated wireless module 108 for each one of the sensors 102, 104, 106, . . . in order to prevent the effort of providing wired connections from multiple sensors to the wireless module 108.

Wireless module 108 has program 110 which generates a WAP request 112, when wireless module 108 receives an alarm signal from at least one of the sensors.

Wireless module 108 uses a transport layer such as GSM, GPRS, UMTS or another wireless transport layer to send the WAP request 112 over wireless network 114 to wireless application protocol (WAP) gateway 116.

Gateway 116 is coupled to monitoring server 118. Gateway 116 converts WAP request 112 to hypertext transfer protocol (HTTP) request 120 which it forwards to monitoring server 118.

Monitoring server 118 has database 122 for storing one or more receiver addresses of mobile clients for each sender address, i.e. for each wireless module 108 or alternatively for each one of the sensors 102, 104, 106, . . . For example each one of the sensors has an Internet protocol (IP) address which serves as a sender address; alternatively an IP of the wireless module 108 serves as a sender address or a combination of the IP addresses of the sensor which issued the alarm signal and the wireless module which has sent the WAP request containing the alarm message.

Further, monitoring server 118 has program 124 for querying database 122 and for storing of data contained in the HTTP request 120 in storage 126. Further program 124 creates an uniform resource identifier (URI) for retrieval of the data which has been stored in storage 126.

Monitoring server 118 is coupled to WAP gateway 128. In response to receiving HTTP request 130 from monitoring server 118, gateway 128 sends SL 132 which contains the URI of the data of the alarm message.

SL 132 is sent to one or more receivers as retrieved from database 122, i.e. to one or more of the mobile clients 134, 136, 138, . . . over wireless network 140.

In operation sensors 102, 104, 106, . . . monitor a surveillance area for the occurrence of an event, such as a fire, smoke, motion and/or sound. When an event is detected by one of the sensors, such as sensor 102, the sensor outputs a corresponding alarm signal which is received by wireless module 108. Sensor 102 can provide additional data, such as the sensor ID of sensor 102 or its IP address, information on the type of event, the detection time etc In response to the alarm signal program 110 of wireless module 108 is invoked. Program 110 generates WAP request 112 which can contain the additional data which is delivered by sensor 102.

WAP request 112 is transmitted over wireless network 114 to gateway 116 where WAP request 112 is converted to a corresponding HTTP request 120. This HTTP request 120 is received by monitoring server 118. This invokes program 124 which queries database 122 in order to determine the receiver address or the receiver addresses which are pre-assigned to the sender address of HTTP request 120. Further, the data which is contained in HTTP request 120 is stored by program 124 in storage 126 and a URI is assigned to the data.

Monitoring server 118 outputs HTTP request 130 containing the URI and the receiver address or receiver addresses. This way monitoring server 118 instructs gateway 128 to send SL 132 containing the URI to the respective mobile clients over wireless network 140. By means of the URI the receiving mobile clients can retrieve the data from storage 126.

Preferably gateway 128 sets the 'execute-high' parameter for SL 132 such that the SL service is carried out in a user-intrusive manner. This ensures that the user's attention is immediately drawn to the alarm signal.

Figure 2:
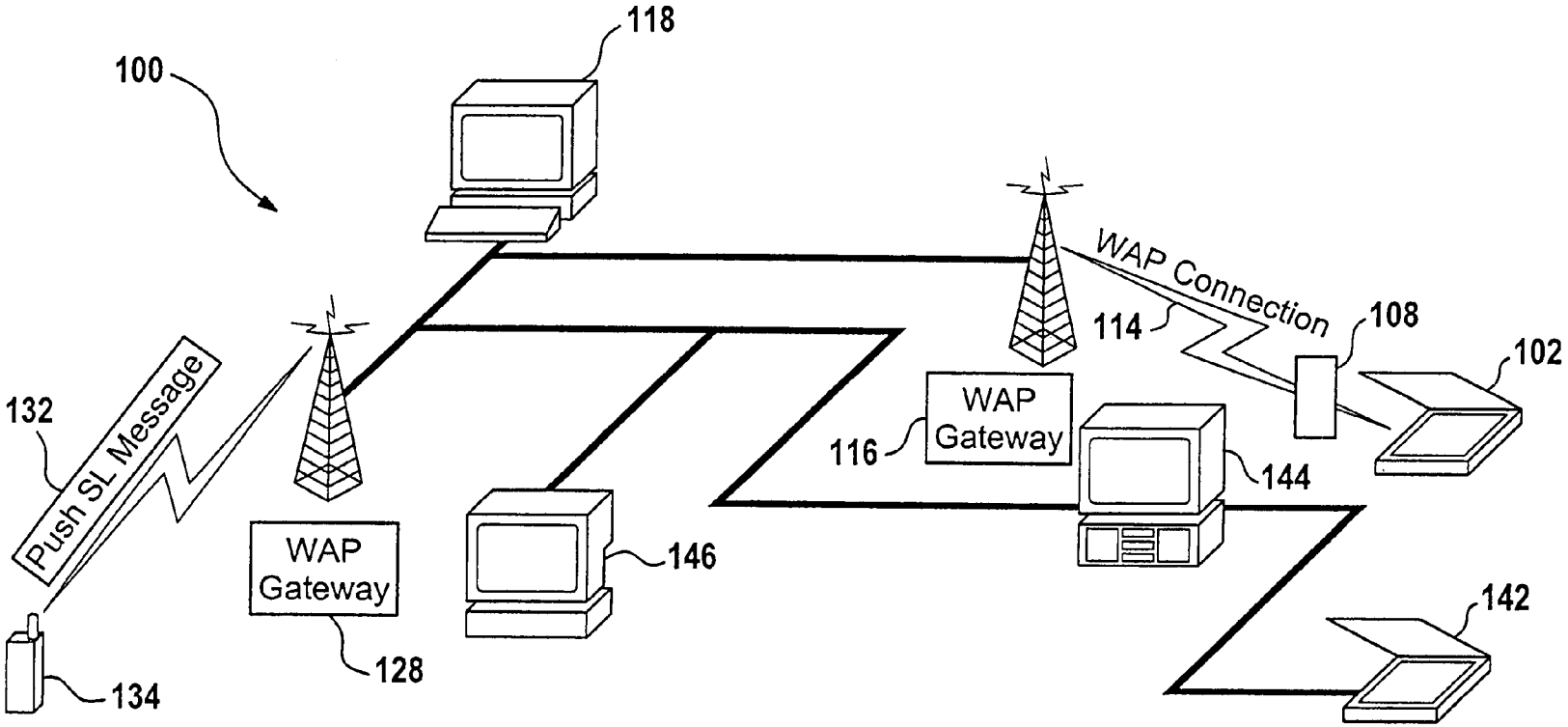
FIG. 2 is a block diagram of a hybrid wireless and wired remote monitoring system.

FIG. 2 shows an alternative hybrid embodiment of a remote monitoring system. Like elements in FIGS. 1 and 2 are designated by the same reference numerals.

In addition to the embodiment of FIG. 1, remote monitoring system 100 of FIG. 2 contains wired system components, i.e. sensor 142, personal computer 144 and personal computer 146. Sensor 142 is wired to personal computer 144.

Personal computers 144 and 146 are connected to monitoring server 118 by means of wired connections, such as over the Internet. When sensor 142 detects an alarm situation it outputs a corresponding alarm signal which is received by personal computer 144 and transmitted to monitoring server 118.

In response monitoring server 118 determines the address of personal computer 146 and forwards the alarm message to this computer. In this instance a uniform resource locator (URL) is provided to personal computer 146 rather than a URI as HTTP is used as a transport protocol rather than WAP.

In order to identify the communication protocol which is to be used to send an alarm message to a receiver each receiver address which is stored in database 122 (cf. FIG. 1) can have an attributive data field for specification of the protocol which is to be used such as WAP or alternatively HTTP.

LIST OF REFERENCE NUMERALS

100 remote monitoring system
102 sensor
104 sensor
106 sensor
108 wireless module
110 program
112 WAP request
114 wireless interlock
116 gateway
118 monitoring server
120 HTTP request
122 database
124 program
126 storage
128 gateway
130 HTTP request
132 SL
134 mobile client
136 mobile client
138 mobile client
140 wireless network
142 sensor
144 personal computer
146 personal computer

The invention claimed is:

1. A remote monitoring method comprising the steps of:

monitoring an occurrence of an event, providing a signal to a wireless module in response to the occurrence of the event, sending a wireless application protocol request being indicative of the occurrence of the event to a first gateway, converting the wireless application protocol request to a first hypertext transfer protocol request, sending of the first hypertext transfer protocol request to a server, determining at least one receiver address for the first hypertext transfer protocol request by the server, sending of a second hypertext transfer protocol request from the server to a second gateway, and sending of a wireless application protocol service loading message to at least one receiver which corresponds to the at least one receiver address from the gateway.

2. The method of claim 1, fire, smoke, motion and/or sound sensors being used for monitoring.

3. The method of claim 1, whereby the signal contains data being indicative of circumstances of the occurrence of the event, whereby the data is sent by means of the wireless application protocol request, and further comprising storing of the data by the server and assigning a uniform resource identifier to the data, and sending of the uniform resource identifier to the at least one receiver by means of the wireless application protocol service loading message.

4. The method of claim 1, the wireless application protocol service loading message being user intrusive.

5. A remote monitoring server comprising:

means for receiving of a first hypertext transfer protocol request from a first wireless application protocol gateway, the first hypertext transfer protocol request being indicative of the occurrence of an event, means for determining at least one receiver address for the first hypertext transfer protocol request, and means for sending of a second hypertext transfer protocol request to a second wireless application protocol gateway in order to initiate a wireless application protocol service loading message to be sent to at least one receiver which corresponds to the at least one receiver address.

6. A remote monitoring system comprising:

means for monitoring an occurrence of an event and for providing a signal to a wireless module in response to the occurrence of the event, means for sending a wireless application protocol request being indicative of the occurrence of the event to a first gateway, means for converting the wireless application protocol request to a first hypertext transfer protocol request, means for sending of the first hypertext transfer protocol request to a server, means for determining at least one receiver address for the first hypertext transfer protocol request, means for sending of a second hypertext transfer protocol request to a second gateway, and means for sending of a wireless application protocol service loading message to at least one receiver which corresponds to the at least one receiver address.

7. The remote monitoring system of claim 6, the means for monitoring comprising a fire, smoke, motion and/or sound sensor.

8. The remote monitoring system of claim 6, further comprising means for storing of data being indicative of circumstances of the occurrence of the event on the server and means for assigning of a uniform resource identifier to the data.

9. The remote monitoring system of claim 6, the second gateway being adapted to set an execute-high parameter for sending of the wireless application service loading message.

* * * * *